United States Patent [19]

Thomason

[11] 4,195,787

[45] Apr. 1, 1980

[54] ROLLED MATERIAL MARKING ARRANGEMENT

[76] Inventor: Raymond Thomason, 211 South Main St., Dawson Springs, Ky. 42408

[21] Appl. No.: 932,035

[22] Filed: Aug. 8, 1978

[51] Int. Cl.[2] ..... B65D 85/67

[52] U.S. Cl. ..... 242/1; 206/390; 206/459; 206/824

[58] Field of Search ..... 206/389, 412, 459, 824, 206/390; 242/1

[56] References Cited

U.S. PATENT DOCUMENTS

| | | | |
|---|---|---|---|
| 1,780,275 | 11/1930 | Randerson | 242/1 |
| 2,857,047 | 10/1958 | Edelson | 206/412 |
| 3,016,137 | 1/1962 | Pollock | 242/1 |
| 3,247,956 | 4/1966 | Rosen | 206/389 |
| 3,537,578 | 11/1970 | Figliuzzi | 242/1 |

*Primary Examiner*—William T. Dixson, Jr.
*Attorney, Agent, or Firm*—Warren D. Flackbert

[57] ABSTRACT

A rolled material marking arrangement, as for bathroom tissue, for example, which selectively indicates the beginning or free end of the roll. In different embodiments, the sectional marking can be from corner to corner; overlapping at corners; offset at corners; and, also decorative in configuration, in any of the suggested forms, typically extending continuously along the roll. The marking can also be laterally disposed on the rolled material.

5 Claims, 7 Drawing Figures

ROLLED MATERIAL MARKING ARRANGEMENT

As is known, it is oftentimes difficult to find the beginning or usable end, for easy access, of products manufactured in a rolled form. In this connection, and by way of example, the invention considers, but is not limited to, conventional bathroom tissue. Other usages include different types and styles of paper towels, friction tape, electrical tape, masking tape and the like.

In any event, the invention provides a marking arrangement which permits easy access to the beginning or front part of the rolled product. Various forms of the invention are suggested including, as in connection with bathroom tissue, a diagonal line which runs from corner to corner for a preselected distance; diagonal lines which overlap at the corners at preselected distances; a diagonal line which is offset from another diagonal line at a preselected distance; a decorative line of any desired configuration which extends through a preselected distance; and, in the alternative, a visable lateral line. Typically, any form of marking is repeated continuously along the length of the rolled product.

The invention, in a simple and positive way, solves an every day problem of where and how to find the free end of a rolled product in a convenient manner. A better understanding of the present invention will become more apparent from the following description, taken in conjunction with the accompanying drawing, wherein FIG. 1 is a top plan view of one form of the invention, showing a corner to corner diagonal marking arrangement;

Figure 1:
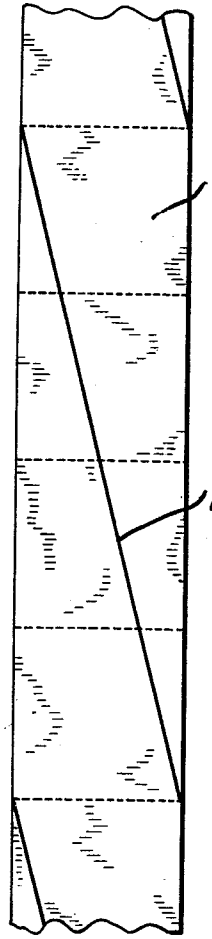

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Figure 2:
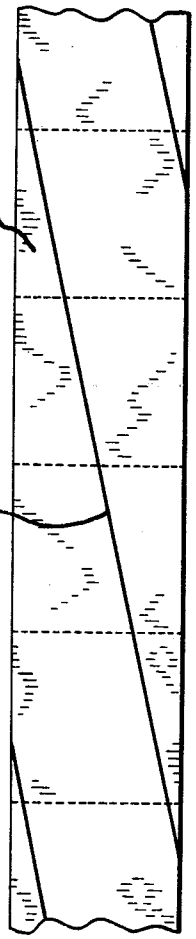
FIG. 2 is another embodiment of the invention, in this instance showing diagonal lines overlapping at corners for the marking arrangement.
Figure 3:
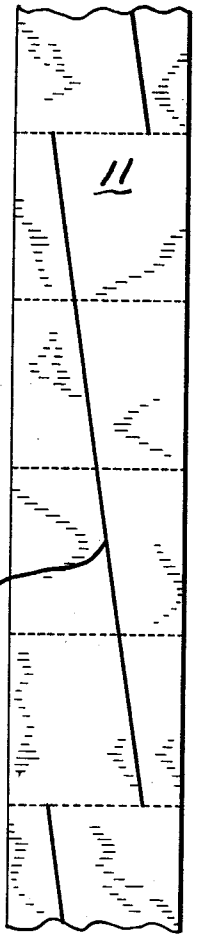
FIG. 3 is still another embodiment of the invention, in this instance showing a diagonal marking line offset at corners on a rolled product.

Referring now to the figures, each of the invention embodiments illustrate alternative forms for marking a rolled product 11, such as bathroom tissue. In this connection, FIG. 1 discloses a diagonal marking line 14 which extends over various segments of the rolled material 11 in a corner to corner relationship. In FIG. 2, diagonal marking lines 14 overlap at preselected segment increments, while, in FIG. 3, the diagonal marking line 14 is offset at the corners of preselected segments of the material, i.e. at a breaking line, where the next diagonal marking is spaced-apart from the preceding diagonal marking.

Figure 4:
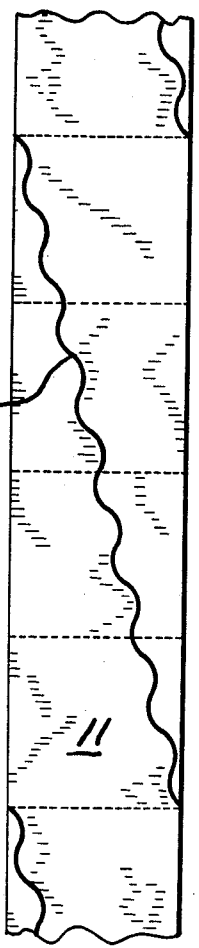
FIG. 4 illustrates a further embodiment of the invention, in this instance showing a decorative marking line.

In FIG. 4, a decorative marking line 14' is suggested for any series of rolled material segments. The invention form of FIG. 4 generally compares to that of FIG. 1, but it should be understood that the invention embodiments of FIGS. 1, 2 and 3 can also use such a decorative marking arrangement.

Figure 5:
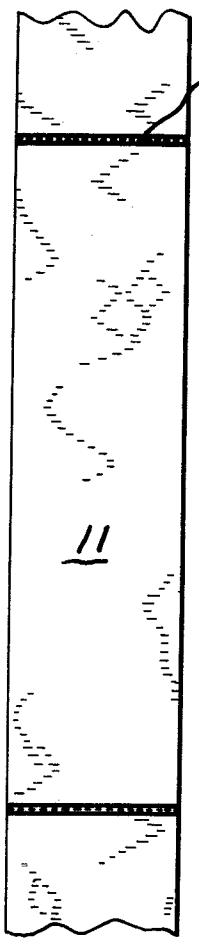
FIG. 5 shows still a further embodiment of the invention, in this instance showing lateral marking lines.
Figure 7:
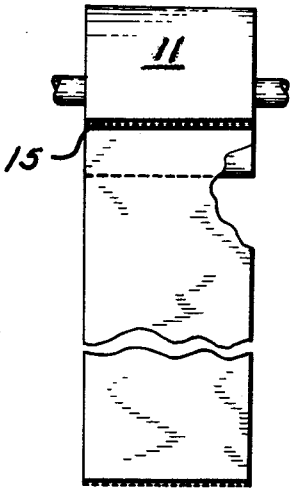

In FIGS. 5 and 7, lateral marking 15 is disclosed, where the segment of the rolled product 11 is longer than shown in FIGS. 1 to 4, inclusive. In any event, the identification of the marking 15 is readily presented on such figures.

Figure 6:
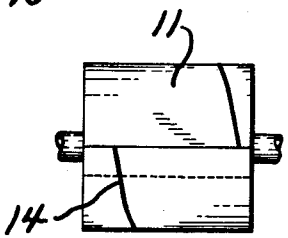
FIG. 6 shows a rolled product prior to removal, but including a marking arrangement of the invention; and, FIG. 7 further illustrates the marking arrangement of FIG. 5, being partly unrolled.

As a matter of reference, FIG. 6, relating mostly to FIGS. 1 to 4, inclusive, shows the marking arrangement when rolled. Such figure makes it quite apparent that the end of the rolled material 11 can be readily seen and access is provided thereto, where, as stated, it should be understood that the marking or pattern preferably is repeated continuously along the length of the rolled material 11.

The invention affords a convenience now known heretofore insofar as rolled products are concerned. The description herein should be considered illustrative and not as limiting the scope of the invention. As a matter of example, the marking line can be varied, either positionwise, length or thickness, or located only at the beginning end of an unused roll of material, and, accordingly, the preceding should not be construed as limiting the following claims:

I claim:

1. A marking arrangement for toilet tissue defined by separable segments comprising imprinted end locating indicia on preselected groupings of said segments.

2. The marking arrangement of claim 1 where said imprinted end locating indicia is repeated continuously on each of said preselected groupings of said segments along the length of said toilet tissue.

3. The marking arrangement of claim 1 where said imprinted end locating indicia extends diagonally from one corner to an opposite corner of each of said preselected groupings of said segments of said toilet tissue.

4. The marking arrangement of claim 1 where said imprinted end locating indicia overlap at preselected corners between each of said preselected groupings of said segments of said toilet tissue.

5. The marking arrangement of claim 1 where said imprinted end locating indicia are offset between each of said preselected groupings of said segments of said toilet tissue.

* * * * *